United States Patent [19]

Jasinski et al.

[11] 3,964,634

[45] June 22, 1976

[54] CHILD RESISTANT SAFETY CAP

[75] Inventors: Andrew S. Jasinski, Grayslake; Robert A. McKirnan, Winnetka, both of Ill.

[73] Assignee: Knight Engineering and Molding Co., Arlington Heights, Ill.

[22] Filed: Sept. 2, 1975

[21] Appl. No.: 609,224

[52] U.S. Cl. ..... 220/281; 220/306; 215/224; 222/153; 222/182

[51] Int. Cl.[2] ..... B65D 43/04

[58] Field of Search ..... 220/281, 306, 85 P; 215/216, 224, 9; 222/153, 182

[56] References Cited

UNITED STATES PATENTS

| | | | |
|---|---|---|---|
| 3,802,607 | 4/1974 | Mead | 222/182 |
| 3,820,683 | 6/1974 | Jasinski | 220/306 |
| 3,854,622 | 12/1974 | McKirnan | 220/306 |

*Primary Examiner*—George T. Hall
*Attorney, Agent, or Firm*—Kinzer, Plyer, Dorn & McEachran

[57] ABSTRACT

A child resistant safety cover for a cylindrical container having a generally annular undersurface located adjacent the top thereof. A cover of this invention can be used with aerosol containers. The safety cover of this invention is formed of a resilient and flexible plastic and has a circular top wall and a tubular wall formed integrally with and depending from the circular top wall. Inwardly extending locking flanges are formed on the lower edge of the tubular wall and are positioned to engage the undersurface of the container when the cover is positioned thereon. Generally diametrically opposed slits are formed in the tubular wall and extend through the lower edge thereof to allow distortion and movement of the locking flanges. Wedging means are carried by the safety cover and are located adjacent to and outwardly of the slits. The wedging means are resiliently movable into the slits to engage and distort the tubular wall and thereby move the locking flanges away from engagement with the undersurface of said container. In one embodiment of the invention, the wedging means are carried by arms which are formed integrally with and depend from the circular top wall. In a second embodiment of the invention, the wedging means are carried on an outer tubular wall formed coaxially with the slitted inner wall and also formed integrally with and depending from the circular said top cover.

14 Claims, 10 Drawing Figures

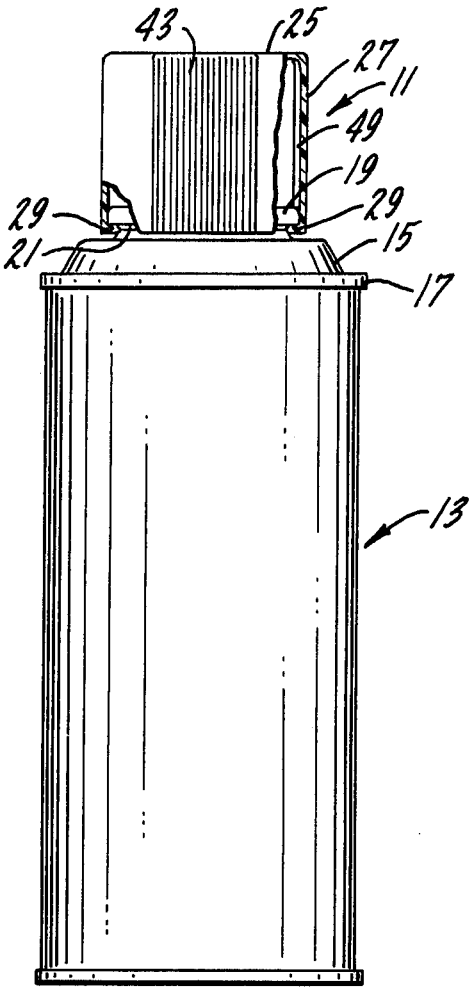
fig.1.
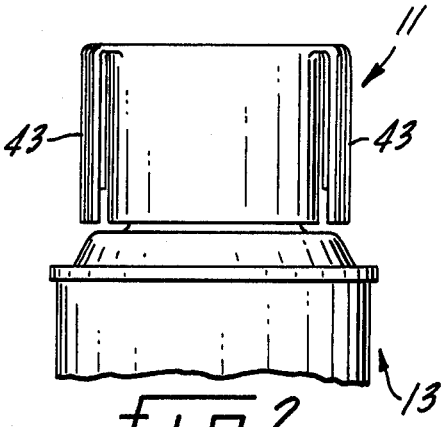
fig.2.
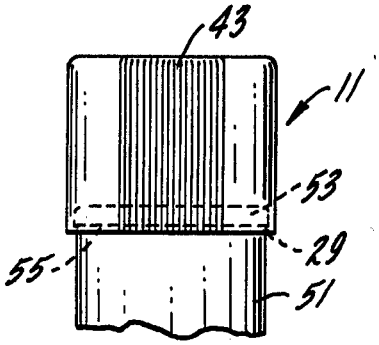
fig.3.
fig.6.
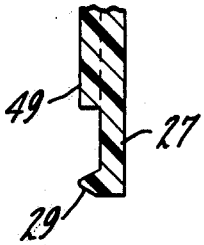
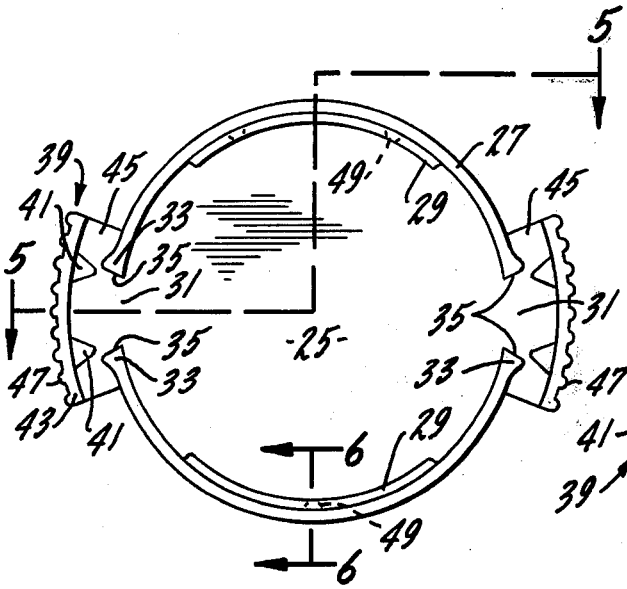
fig.4.
fig.5.
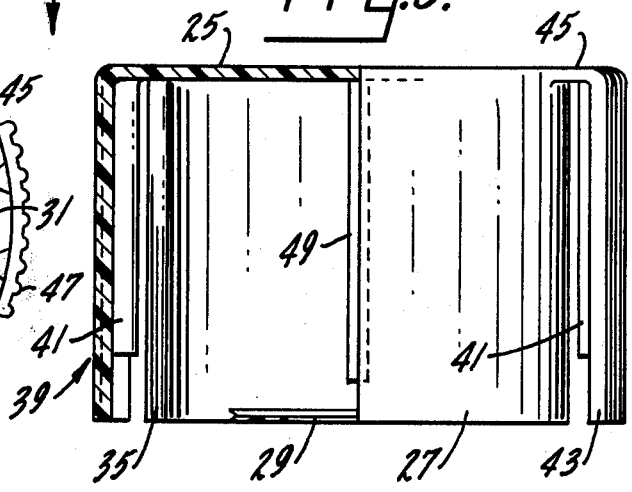

fig.7.
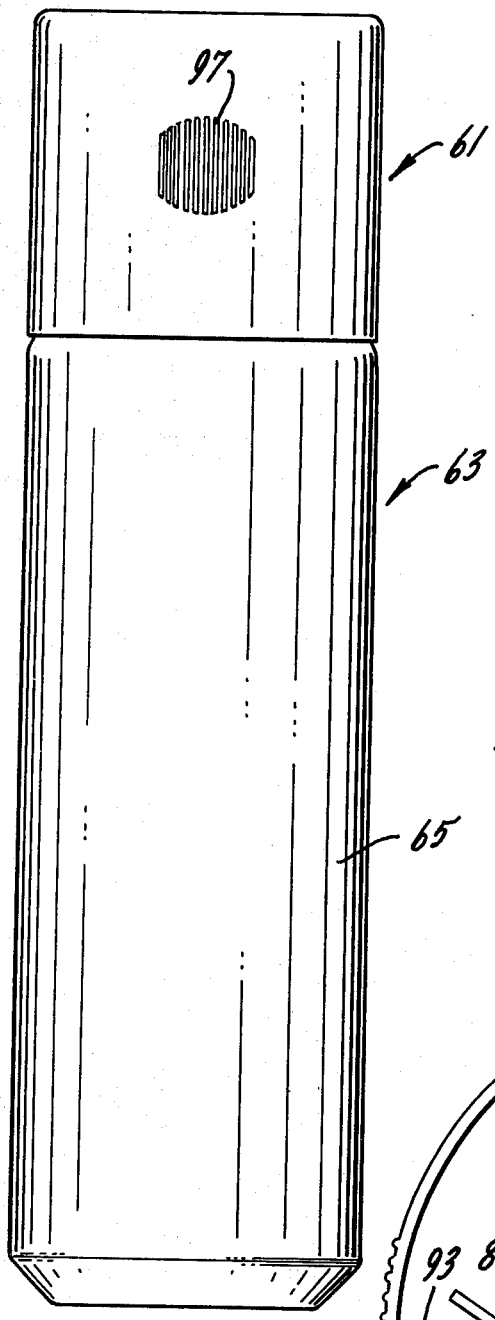
fig.8.
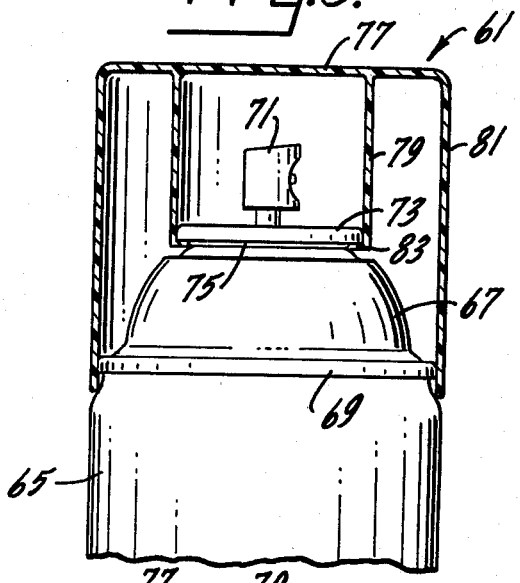
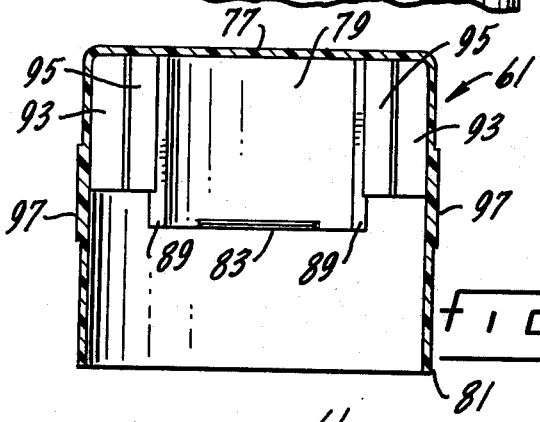
fig.9.
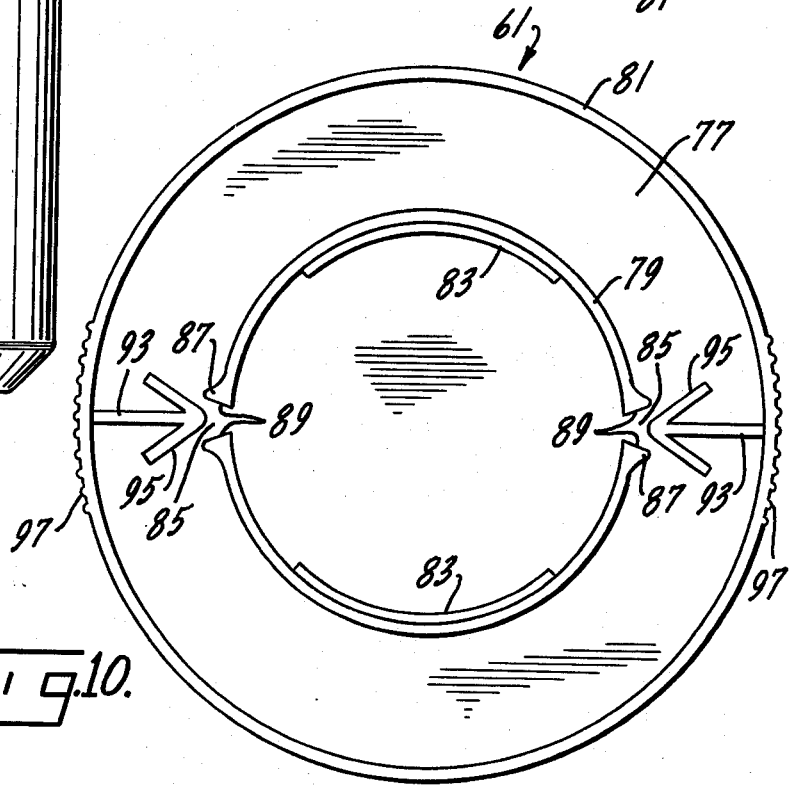
fig.10.

CHILD RESISTANT SAFETY CAP

SUMMARY OF THE INVENTION

This invention is concerned with a child resistant safety cover for a cylindrical container and particularly for a cylindrical container of the aerosol type.

An object of this invention is a child resistant safety cover for a container which can be unlocked from the container by a wedging action.

Another object is a child resistant safety cover for a container which must be squeezed in designated locations and tilted in order to effectuate removal of the cover from the container.

Another object is a child resistant safety cover which can be molded in either single shell or double shell construction.

Other objects may be found in the following specification, claims and drawings.

BRIEF DESCRIPTION OF THE DRAWINGS

The invention is illustrated more or less diagrametically in the following drawings wherein:

FIG. 1 is a side elevational view of one form of container equipped with a child resistant safety cover of this invention;

FIG. 2 is a side elevational view of the safety cap of FIG. 1 rotated 90°;

FIG. 3 is a side elevational view of the child resistant safety cap of FIG. 1 applied to a small diameter container;

FIG. 4 is an enlarged bottom view of the child resistant safety cap of FIG. 1;

FIG. 5 is an enlarged cross sectional view taken along line 5—5 of FIG. 4;

FIG. 6 is an enlarged cross sectional view taken along line 6—6 of FIG. 4;

FIG. 7 is a modified form of a child resistant safety cap mounted on a large diameter container of the aerosol type;

FIG. 8 is a partial side elevational view of the child resistant safety cap and container of FIG. 7 with the cap shown in cross section viewed at 90° from the view of FIG. 7;

FIG. 9 is a cross sectional view of the cap of FIG. 7, and

FIG. 10 is an enlarged bottom view of the child resistant safety cover of FIG. 7.

DESCRIPTION OF THE PREFERRED EMBODIMENTS

FIG. 1 of the drawings shows a child resistant safety cover 11 of this invention applied to a container 13. In this example, the container 13 is of the aerosol type and is cylindrical in shape. It is enclosed at its upper end by a domed top wall 15 secured thereto by an upstanding annular rim 17. A valve actuator (not shown) is mounted on the dome top and is surrounded by an annular collar 19. The annular collar has an undersurface 21 on the outer side thereof which is spaced from the dome top.

The child resistant safety cover 11 is formed of a suitable resilient and flexible plastic such as polypropylene or an olefin having suitable memory characteristics. The cover may be formed in one piece by a suitable injection molding process. It includes a circular top wall 25 formed integrally with a depending tubular wall 27. As is shown most clearly in FIGS. 1, 4, 5 and 6, a pair of generally diametrically opposed inwardly projecting lips or locking flanges 29 are formed at the lower edge of the tubular wall 27. The locking flanges each extend through an arc of approximately 80° in this embodiment of the invention. Of course, it should be understood that the arcuate extent of the locking flanges may be varied as conditions dictate.

A pair of diametrically opposed openings or slits 31 are formed in the tubular wall 27 and extend from the lower edge thereof upwardly towards the circular top wall 25 but may stop short thereof. The slits 31 are located generally at right angles to the locking flanges 29. The tubular wall 27 is thickened on opposite sides of the openings or slits 31 to form ribs 33. Each rib has a wedge engaging surface 35 which faces outwardly. Both the width and length of the slits 31 may be varied depending upon the size of the child resistant cover and the characteristics of the plastic used in forming the cover as well as the amount of force which must be exerted by the user to remove the cover from the container.

A wedging means 39 for spreading the tubular wall 27 is positioned radially outwardly of each slit 31. In this embodiment of the invention, the wedging means consists of a pair of spaced triangular shaped wedges 41, each of which can be moved into engagement with a wedge engaging surface 35 formed on a rib 33 bordering a slit 31. The wedges are formed integrally with arcuate shaped arms 43. The arms connect with fan shaped top portions 45 which are formed integrally with and extend outwardly of the circular top wall 25. Thin longitudinally extending ribs 47 are formed on the outer surfaces of the arcuate arms 43 to indicate pressure applying areas. Stop members embodied in longitudinally extending ribs 49 are formed on the inner surface of the tubular wall 27. The bottoms of these ribs engage the top of the annular collar 19 of the container 13 when the cover is placed thereon to control the seated position of the cover.

FIG. 3 of the drawings shows the child resistant safety cover 11 positioned on a container 51 of the aerosol type which is smaller in diameter than the container 13. Containers of this type commonly contain butane fuel for cigarette lighters and include a generally flat top wall (not shown) surrounded by an annular collar 53. The annular collar has an outwardly located undersurface 55 which is engaged by the locking flanges 29 of the cover 11. Thus, the child resistant safety cover 11 may be used on both standard and small diameter aerosol containers.

A modified form of child resistant safety cover 61 is shown in FIGS. 7 through 10 of the drawings applied to a large diameter container 63 which, in this example, is an aerosol container having a one-piece body and commonly known as a drawn and ironed container. The one-piece body portion 65 of the container is cylindrical in shape and is enclosed at its upper end by a domed top wall 67 secured thereto by an annular rim 69. A valve actuator 71 is mounted on the domed top and is surrounded by an annular collar 73. The annular collar has an undersurface 75 on the outer side thereof which is spaced from the domed top wall.

The child resistant safety cover 61 is formed of a suitable resilient and flexible plastic such as polypropylene or an olefin plastic having suitable memory characteristics. The cover may be molded in one piece by a suitable injection molding process. The cover includes a circular top wall 77 having inner and outer tubular walls 79 and 81, respectively, depending therefrom. The inner tubular wall is shorter in length than the outer tubular wall as is shown in FIGS. 8 and 9 of the drawings. A pair of diametrically opposed inwardly projecting lips or locking flanges 83 are formed at the lower edge of the inner tubular wall 79. The locking flanges each extend through an arc of approximately 80° in this embodiment of the invention. Of course, the arcuate extent of the locking flanges may be varied as conditions dictate. A pair of diametrically opposed openings or slits 85 are formed in the inner tubular wall 79 and extend from the lower edge thereof upwardly towards the circular top wall 77 of the cover, stopping short thereof. The slits 85 are located generally at right angles to the locking flanges 83. The inner tubular wall 79 is enlarged or thickened on opposite sides of the slits to form ribs 87. Each rib has an outwardly facing wedge engaging surface 89.

Wedging means 93 are positioned outwardly of the slits 85 and are movable into and out of engagement with the wedging surfaces 89 to deform the inner tubular wall 79 and move the locking flanges 83 radially outwardly. Each wedging member 93 is in the form of a rib, formed integrally with and located on the inner surface of the outer tubular wall 81 of the cover. Each wedging member extends downwardly from the circular top wall 77 and terminates short of the lower edge of the inner tubular wall 79. Each wedging member is arrow shaped in transverse cross section and includes an inverted V-shaped tip 95 which contacts the wedge engaging surfaces 89 of the ribs 87. Pressure applying locations for actuating the wedging means are indicated by ribbing 97 formed on the outer surface of the outer tubular wall 81. These ribs are positioned in alignment with the wedging means 93 and extend below the lower edge of the wedging means. The diameter of the outer tubular wall 81 is formed so that its outer surface is flush with the outer surface of the cylindrical body portion 65 of the aerosol container.

The use, operation, function of this invention are as follows:

The child resistant safety cover 11 shown in FIGS. 1 through 6 of the drawings can be removed from the container 11 only by a prescribed sequence of steps. The first step involves simultaneous inwardly directed movement or squeezing of the arms 43. The inwardly directed squeezing of the arms 43 moves the wedges 41 of the wedging means 39 into engagement with the surfaces 35 located on the ribs 33 at opposite sides of the slits 31 in the tubular wall 27 of the cover. The spreading action of the wedges 41 on the wedge engaging surfaces 35 deforms the tubular wall 27 of the cover and moves the locking flanges 29 outwardly from engagement with the undersurface 21 of the container 13. With the arms 43 squeezed inwardly, the cover 11 can be canted or tilted for removal from the container 13. Thus, removal of the cover 11 from the container 13 requires a sequence of steps that is normally beyond the capability of a younger child. The requirement that the arms 43 be squeezed inwardly in order to release the cover is not readily apparent to a younger child. The adult user can obtain removal instructions which can be printed or otherwise formed on the top surface 25 of the cover. The arcuate shaped arms 43 screen the slits or openings 31 in the cover, thereby both rendering the mode of release of the cover unobvious to a child and shielding the slits to provide a pleasing appearance for the cover.

The child resistant safety cover 61 shown in FIGS. 7 through 10 of the drawings also requires a prescribed sequence of steps. Squeezing forces must be simultaneously applied to the ribbed areas 97 in order to release the locking flanges 83 from engagement with the undersurface 75 of the annular collar 73 of the cover. Inwardly directed forces applied to the ribbed areas 97 of the outer tubular wall 81 move the tips 95 of the wedges 93 into contact with the wedge engaging surfaces 89 on the ribs 87 at opposite sides of the slits 85 in the inner tubular wall 79. Continued inward movement of the wedges 93 distorts the inner tubular wall 97 thus moving the locking flanges 83 out from engagement with the undersurface 75. The cover 61 may then be removed from the container by a canting and/or tilting action. The instructions for applying squeezing forces to the cover may be imprinted or otherwise formed on the circular top surface 77 of the cover. The proper method of removal of the cover 61 is not apparent to young children, who, in any event, would have difficulty properly applying inwardly directed squeezing force to the designated areas 97 of the cover.

We claim:

1. A child resistant safety cover for a cylindrical container having a generally annular undersurface located adjacent the top thereof, said safety cover being formed of a resilient and flexible plastic and including:

a circular top wall, a tubular wall depending from said circular top wall, at least one locking flange projecting inwardly from the lower edge of said tubular wall and positioned to engage said undersurface of said container when said cover is positioned on the container, at least one slit formed in said tubular wall and extending through said lower edge of said tubular wall to allow distortion and movement of said locking flange, and wedging means carried by said cover and located adjacent to and outwardly of said slit, said wedging means being resiliently movable into said slit to engage and distort said tubular wall and thereby move said locking flange away from engagement with said undersurface of said container.

2. The child resistant safety cover of claim 1 in which each of a pair of locking flanges projects inwardly from the lower edge of said tubular wall with said locking flanges being spaced from and located generally opposite to each other.

3. The child resistant safety cover of claim 1 in which each of a pair of locking flanges projects inwardly from the lower edge of said tubular wall, a pair of slits are formed in said tubular wall with said slits being located generally diametrically of each other and between said locking flanges, and a wedging means is positioned adjacent to and outwardly of each slit.

4. The child resistant safety cover of claim 3 in which each locking flange extends through an arc less than the distance between said slits with said locking flanges being located generally diametrically opposite to each other.

5. The child resistant safety cap of claim 1 in which the wedging means is carried by an arm depending from said circular top wall.

6. The child resistant safety cap of claim 5 in which said arm is formed integrally with said circular top wall.

7. The child resistant safety cap of claim 3 in which each wedging means is carried by an arm depending from said circular top wall.

8. The child resistant safety cap of claim 7 in which each arm is formed integrally with said circular top wall.

9. The child resistant safety cap of claim 5 in which said arm screens said slit.

10. The child resistant safety cap of claim 7 in which each arm screens a slit.

11. The child resistant safety cap of claim 5 in which said arm has an arcuate extent greater than the arcuate extent of said slit.

12. The child resistant safety cap of claim 7 in which each arm has an arcuate extent greater than the arcuate extent of its slit.

13. The child resistant safety cap of claim 1 in which said wedging means is carried by tubular wall positioned outwardly of and coaxial with said slitted tubular wall.

14. The child resistant safety cap of claim 13 in which each of a pair of locking flanges projects inwardly from the lower edge of said slitted tubular wall, a pair of slits are formed in said slitted tubular wall with said slits being located generally diametrically of each other and between said locking flanges and a wedging means is positioned adjacent to and outwardly of each slit with both said wedging means carried by said outer tubular wall.

* * * * *